US010351369B2

(12) United States Patent
Odajima

(10) Patent No.: US 10,351,369 B2
(45) Date of Patent: Jul. 16, 2019

(54) SHEET STACKING APPARATUS, SHEET FEEDING APPARATUS, IMAGE FORMING APPARATUS, AND IMAGE FORMING SYSTEM

(71) Applicant: CANON FINETECH NISCA INC., Misato-shi (JP)

(72) Inventor: Shota Odajima, Yashio (JP)

(73) Assignee: Canon Finetech Nisca Inc., Misato-shi (JP)

( * ) Notice: Subject to any disclaimer, the term of this patent is extended or adjusted under 35 U.S.C. 154(b) by 0 days.

(21) Appl. No.: 15/946,074

(22) Filed: Apr. 5, 2018

(65) Prior Publication Data

US 2018/0312352 A1 Nov. 1, 2018

(30) Foreign Application Priority Data

Apr. 27, 2017 (JP) ..... 2017-088573

(51) Int. Cl.
*B65H 1/14* (2006.01)

(52) U.S. Cl.
CPC ..... *B65H 1/14* (2013.01); *B65H 2403/544* (2013.01); *B65H 2405/15* (2013.01); *B65H 2801/06* (2013.01)

(58) Field of Classification Search
CPC ..... B65H 1/08; B65H 1/14; B65H 2403/544; B65H 2403/5441; B65H 2405/11; B65H 2405/111; B65H 2405/1111; B65H 2405/15
See application file for complete search history.

(56) References Cited

U.S. PATENT DOCUMENTS 5,305,996 A * 4/1994 Taniwa ..... B65H 1/12 271/126
5,700,006 A * 12/1997 Sekiya ..... B65H 1/14 271/147
5,790,933 A * 8/1998 Williams ..... B65H 1/14 271/126
8,523,171 B2 * 9/2013 Fujita ..... B65H 1/14 271/108
8,714,543 B2 * 5/2014 Matsushima ..... B65H 1/14 271/147
8,777,214 B2 * 7/2014 Naoi ..... B65H 1/14 271/147

(Continued)

FOREIGN PATENT DOCUMENTS

JP 07-300245 A 11/1995

*Primary Examiner* — Ernesto A Suarez
(74) *Attorney, Agent, or Firm* — Venable LLP

(57) ABSTRACT

A sheet stacking apparatus includes a tray capable of stacking plural sheets, and four wires with one end of each of them being connected to a corresponding one of portions at four corners of the tray. On the downstream side of the tray concerning a sheet feeding direction, the other end of each of two wires is connected via pulleys provided above the tray. A winding unit in the apparatus vertically moves the tray hung by the four wires by winding up or rolling down the two wires. On a side opposite to the side of the tray where the connecting portion to which one end of each of the two wires connected to the winding unit is connected, the other end of each of the remaining two wires are connected via pulleys provided above and below the tray, respectively.

15 Claims, 9 Drawing Sheets

(56) References Cited

U.S. PATENT DOCUMENTS

| | | | | |
|---|---|---|---|---|
| 8,783,677 | B2 * | 7/2014 | Matsushima | B65H 1/14 271/147 |
| 9,701,495 | B2 * | 7/2017 | Ito | B65H 1/14 |
| 9,796,543 | B2 * | 10/2017 | Sato | B65H 3/66 |
| 2011/0024970 | A1 * | 2/2011 | Uchida | B65H 1/14 271/10.16 |
| 2018/0354738 | A1 * | 12/2018 | Yazawa | B65H 1/04 |
| 2019/0002218 | A1 * | 1/2019 | Shimura | B65H 1/08 |

* cited by examiner

SHEET STACKING APPARATUS, SHEET FEEDING APPARATUS, IMAGE FORMING APPARATUS, AND IMAGE FORMING SYSTEM

BACKGROUND OF THE INVENTION

Field of the Invention

The present invention relates to a sheet stacking apparatus that feeds stacked sheets, a sheet feeding apparatus that includes this sheet stacking apparatus, an image forming apparatus that includes the sheet feeding apparatus, and an image forming system.

Description of the Related Art

In image forming apparatuses such as a copying machine and a printer, there is known an apparatus that includes a sheet storage unit and a feeding mechanism such as a feeding roller which feeds sheets stored in the sheet storage unit, and configured to feed the sheets stored in the sheet storage unit to an image forming unit by the feeding mechanism. In recent years, out of such image forming apparatuses, the number of apparatuses each including a large-volume sheet storage unit capable of supplying a large volume of sheets as many as several thousand sheets increases.

Furthermore, in a recent print industry, needs (for example, book jackets, double-page spreads of catalogs, or POP advertisements) to perform printing on elongated paper rather than plain paper of A3, A4, or the like have grown.

A lifter mechanism of a conventional sheet feeding apparatus adopts an arrangement using wires and pulleys so as to implement a simple and low-cost arrangement. However, the vertical moving performance of a sheet stacking tray is degraded due to the relationship between the barycenter of stacked sheets and the hanging fulcrums of the wires. To cope with this, there has been proposed a feeding apparatus that hangs and supports a sheet stacking tray stably by providing wire fulcrums outside the barycenters of sheet members of various sizes stacked on the sheet stacking tray with respect to the barycenters (see Japanese Patent Laid-Open No. 7-300245).

In the related art, however, the wire fulcrums are provided in four portions of the front/rear end portions of the sheet stacking tray and connected to different wires, and these four portions are lifted by the driving force of a motor, requiring an arrangement that fixes the wires to both the front/rear end portions or an arrangement that winds up the wires. This requires a space for including the arrangement that fixes or winds up the wires in the front/rear of the sheet stacking tray, causing a problem that the apparatus has to be increased in size.

SUMMARY OF THE INVENTION

Accordingly, the present invention is conceived as a response to the above-described disadvantages of the conventional art.

For example, a sheet stacking apparatus, a sheet feeding apparatus, an image forming apparatus, and an image forming system according to this invention are capable of vertically moving a sheet stacking tray stably with a simple arrangement.

According to one aspect of the present invention, there is provided a sheet stacking apparatus comprising: a stacking unit capable of stacking a sheet; a restriction unit movable, in a conveyance direction in which the sheet stacked by the stacking unit is conveyed, in a restriction direction of restricting movement of the sheet stacked by the stacking unit and a release direction of releasing the restriction; a first lifting unit configured to lift the stacking unit; a second lifting unit different from the first lifting unit to lift the stacking unit; a third lifting unit different from the first lifting unit and the second lifting unit to lift the stacking unit; and a roll-up unit configured to raise the stacking unit by rolling up the first lifting unit and the second lifting unit, and lowering the stacking unit by releasing the first lifting unit and the second lifting unit, wherein the stacking unit includes, in the conveyance direction, a first connecting portion, a second connecting portion, and a third connecting portion to which the first lifting unit, and the second lifting unit, and the third lifting unit are, respectively, connected at a plurality of positions and an elongated hole for the restriction unit to move, in the conveyance direction, the second connecting portion is provided on a downstream side of the third connecting portion, and the first connecting portion is provided on the downstream side of the second connecting portion, the first lifting unit is provided to be connected to the first connecting portion and to lift the stacking unit by acting on the first connecting portion when rolled up by the roll-up unit, the second lifting unit is provided to be connected to the second connecting portion and to lift the stacking unit by acting on the second connecting portion when rolled up by the roll-up unit, and the third lifting unit is provided to be connected to the second connecting portion at one end, to be connected to the third connecting portion at the other end, and when the roll-up unit rolls up the first lifting unit and the second lifting unit, to be drawn to the second connecting portion lifted by an action of the second lifting unit and to lift the stacking unit by acting on the third connecting portion on the stacking unit.

According to another aspect of the present invention, there is provided a sheet feeding apparatus comprising: a stacking unit capable of stacking a sheet; a restriction unit movable, in a conveyance direction in which the sheet stacked by the stacking unit is conveyed, in a restriction direction of restricting movement of the sheet stacked by the stacking unit and a release direction of releasing the restriction; a feeding unit configured to contact and feed an uppermost sheet stacked by the stacking unit; a first lifting unit configured to lift the stacking unit; a second lifting unit different from the first lifting unit to lift the stacking unit; a third lifting unit different from the first lifting unit and the second lifting unit to lift the stacking unit; and a roll-up unit configured to raise the stacking unit by rolling up the first lifting unit and the second lifting unit, and lowering the stacking unit by releasing the first lifting unit and the second lifting unit, wherein the stacking unit includes, in the conveyance direction, a first connecting portion, a second connecting portion, and a third connecting portion to which the first lifting unit, and the second lifting unit, and the third lifting unit are, respectively, connected at a plurality of positions and an elongated hole for the restriction unit to move, in a direction parallel to a long side of a sheet with a maximum length stackable by the stacking unit, the second connecting portion is provided closer to a side of the restriction direction than the third connecting portion, and the first connecting portion is provided closer to the side of the restriction direction than the second connecting portion, the first lifting unit is provided to be connected to the first connecting portion and to lift the stacking unit by acting on the first connecting portion when rolled up by the roll-up unit, the second lifting unit is provided to be connected to the second connecting portion and to lift the stacking unit by acting on the second connecting portion when rolled up by the roll-up unit, and the third lifting unit is provided to be connected to the second connecting portion at one end, to be connected to the third connecting portion at the other end, and when the roll-up unit rolls up the first lifting unit and the second lifting unit, to be drawn to the second connecting portion lifted by an action of the second lifting unit and to lift the stacking unit by acting on the third connecting portion on the stacking unit.

According to still another aspect of the present invention, there is provided an image forming apparatus comprising: a stacking unit capable of stacking a sheet; a restriction unit movable, in a conveyance direction in which the sheet stacked by the stacking unit is conveyed, in a restriction direction of restricting movement of the sheet stacked by the stacking unit and a release direction of releasing the restriction; a feeding unit configured to contact and feed an uppermost sheet stacked by the stacking unit; an image forming unit configured to form an image on the sheet fed by the feeding unit; a first lifting unit configured to lift the stacking unit; a second lifting unit different from the first lifting unit to lift the stacking unit; a third lifting unit different from the first lifting unit and the second lifting unit to lift the stacking unit; and a roll-up unit configured to raise the stacking unit by rolling up the first lifting unit and the second lifting unit, and lowering the stacking unit by releasing the first lifting unit and the second lifting unit, wherein the stacking unit includes, in the conveyance direction, a first connecting portion, a second connecting portion, and a third connecting portion to which the first lifting unit, and the second lifting unit, and the third lifting unit are, respectively, connected at a plurality of positions and an elongated hole for the restriction unit to move, in the conveyance direction, the second connecting portion is provided on a downstream side of the third connecting portion, and the first connecting portion is provided on the downstream side of the second connecting portion, the first lifting unit is provided to be connected to the first connecting portion and to lift the stacking unit by acting on the first connecting portion when rolled up by the roll-up unit, the second lifting unit is provided to be connected to the second connecting portion and to lift the stacking unit by acting on the second connecting portion when rolled up by the roll-up unit, and the third lifting unit is provided to be connected to the second connecting portion at one end, to be connected to the third connecting portion at the other end, and when the roll-up unit rolls up the first lifting unit and the second lifting unit, to be drawn to the second connecting portion lifted by an action of the second lifting unit and to lift the stacking unit by acting on the third connecting portion on the stacking unit.

According to still another aspect of the present invention, there is provided an image forming system comprising: a sheet feeding apparatus; and an image forming apparatus, wherein the sheet feeding apparatus comprises: a stacking unit capable of stacking a sheet; a restriction unit movable, in a conveyance direction in which the sheet stacked by the stacking unit is conveyed, in a restriction direction of restricting movement of the sheet stacked by the stacking unit and a release direction of releasing the restriction; a feeding unit configured to contact and feed an uppermost sheet stacked by the stacking unit; a first lifting unit configured to lift the stacking unit; a second lifting unit different from the first lifting unit to lift the stacking unit; a third lifting unit different from the first lifting unit and the second lifting unit to lift the stacking unit; and a roll-up unit configured to raise the stacking unit by rolling up the first lifting unit and the second lifting unit, and lowering the stacking unit by releasing the first lifting unit and the second lifting unit, wherein the stacking unit includes, in the conveyance direction, a first connecting portion, a second connecting portion, and a third connecting portion to which the first lifting unit, and the second lifting unit, and the third lifting unit are, respectively, connected at a plurality of positions and an elongated hole for the restriction unit to move, in a direction parallel to a long side of a sheet with a maximum length stackable by the stacking unit, the second connecting portion is provided closer to a side of the restriction direction than the third connecting portion, and the first connecting portion is provided closer to the side of the restriction direction than the second connecting portion, the first lifting unit is provided to be connected to the first connecting portion and to lift the stacking unit by acting on the first connecting portion when rolled up by the roll-up unit, the second lifting unit is provided to be connected to the second connecting portion and to lift the stacking unit by acting on the second connecting portion when rolled up by the roll-up unit, the third lifting unit is provided to be connected to the second connecting portion at one end, to be connected to the third connecting portion at the other end, and when the roll-up unit rolls up the first lifting unit and the second lifting unit, to be drawn to the second connecting portion lifted by an action of the second lifting unit and to lift the stacking unit by acting on the third connecting portion on the stacking unit, and the image forming apparatus comprises an image forming unit configured to form an image on the sheet fed by the feeding unit.

The invention is particularly advantageous since it is possible to vertically move a stacking tray stably with a simple arrangement.

Further features of the present invention will become apparent from the following description of exemplary embodiments (with reference to the attached drawings).

DESCRIPTION OF THE EMBODIMENTS

Exemplary embodiments of the present invention will now be described in detail in accordance with the accompanying drawings. However, the present invention is not limited to embodiments to be described below, and a change and an addition may be made without departing from the scope of the present invention.

In this specification, the terms "print" and "printing" not only include the formation of significant information such as characters and graphics, but also broadly include the formation of images, figures, patterns, and the like on a print medium, or the processing of the medium, regardless of whether they are significant or insignificant and whether they are so visualized as to be visually perceivable by humans.

Also, the term "print medium (or sheet)" not only includes a paper sheet used in common printing apparatuses, but also broadly includes materials, such as cloth, a plastic film, a metal plate, glass, ceramics, wood, and leather, capable of accepting ink.

<Outline of Image Forming Apparatus (FIG. 1)>

Figure 1:
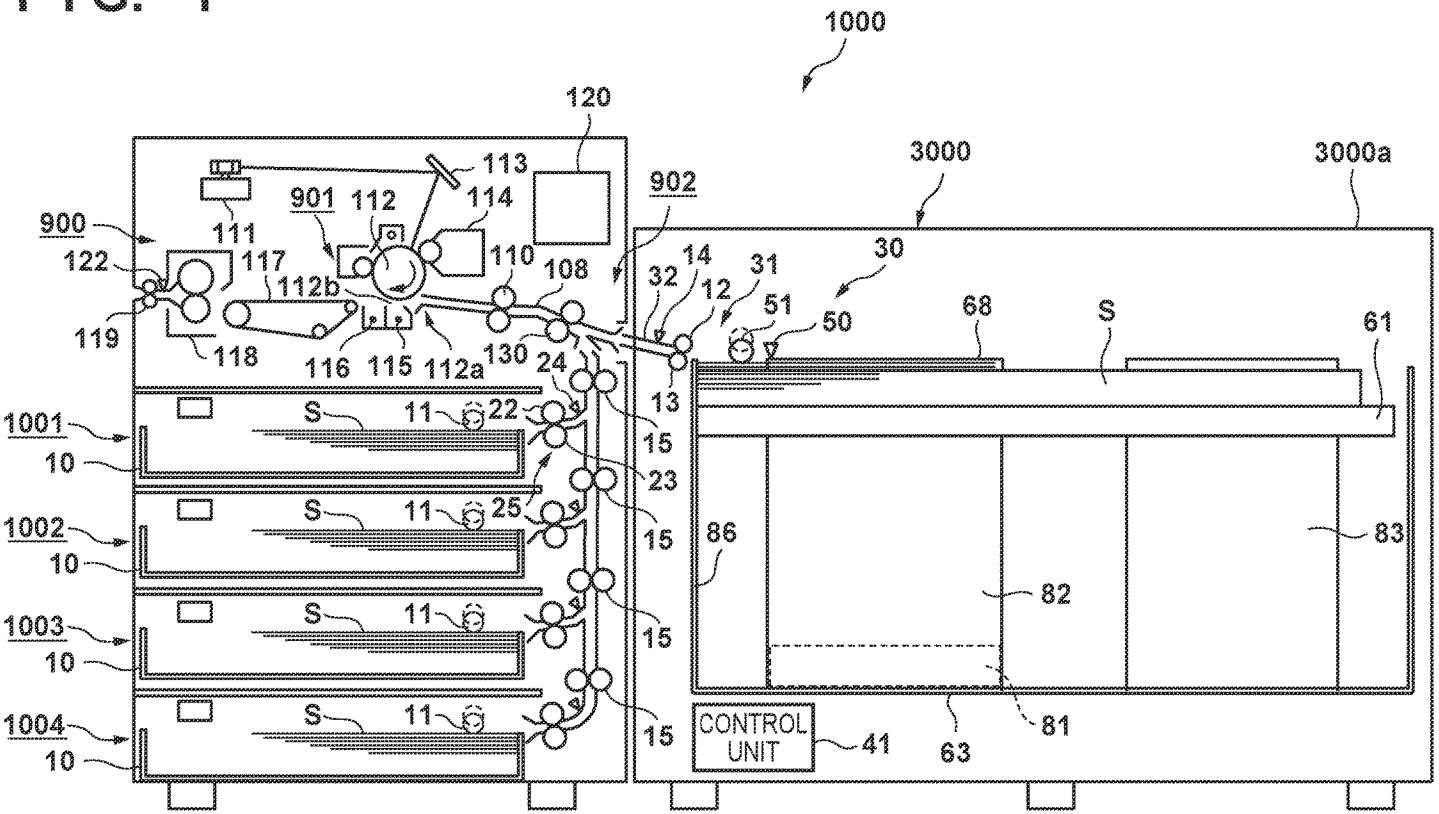
FIG. 1 is a side sectional view showing the schematic arrangement of an image forming apparatus that includes a sheet feeding apparatus according to an exemplary embodiment of the present invention.

FIG. 1 is a side sectional view showing the schematic arrangement of an image forming system 1000 that forms an image in accordance with an electrophotographic method according to an exemplary embodiment of the present invention.

As shown in FIG. 1, the image forming system 1000 includes an image forming apparatus (LBP) 900 and a paper deck 3000 connected to the image forming apparatus 900. The paper deck 3000 includes a control unit 41 with a CPU, a RAM, and a ROM, which controls the paper deck 3000 in accordance with a command of a controller 120 that controls the entire image forming system 1000.

The image forming apparatus 900 includes first to fourth sheet feeding apparatuses 1001 to 1004 of the same arrangement that feed sheets S and a sheet conveying apparatus 902 that conveys the sheets S fed by the sheet feeding apparatuses 1001 to 1004 to an image forming unit 901. The controller 120 provided in the image forming apparatus 900 includes the CPU, the RAM, and the ROM in order to control the respective units of the image forming system 1000. In addition, the controller 120 generates an image signal upon receiving image data from the outside (for example, a PC or the like) and outputs this to the image forming unit.

Each of the first to fourth sheet feeding apparatuses 1001 to 1004 includes a paper feed cassette 10 that stores the sheets S, a pickup roller 11, and a separation/conveyance roller pair 25 constituted by a feed roller 22 and a retard roller 23. Each sheet S stored in the paper feed cassette 10 is separated and fed by the pickup roller 11 and the separation/conveyance roller pair 25 each performing a vertical moving operation and rotating at a predetermined timing. A feeding sensor 24 is arranged near the downstream side of the roller 22 and retard roller 23 in a sheet feeding direction. The feeding sensor 24 detects passage of the sheets S, and transmits a detection signal to the controller 120.

The sheet conveying apparatus 902 includes conveyance roller pairs 15, a pre-registration roller pair 130, and a registration roller pair 110. The sheet S fed from each of the first to fourth sheet feeding apparatuses 1001 to 1004 is passed through a sheet conveyance path 108 by the conveyance roller pairs 15 and the pre-registration roller pair 130, and then guided to the registration roller pair 110. Subsequently, the sheet S is fed to the image forming unit 901 at a predetermined timing by the registration roller pair 110.

The image forming unit 901 includes, for example, a photosensitive drum 112, a laser scanner 111, a developing device 114, a transfer charger 115, and a separation charger 116. Then, at the time of image formation, laser light from the laser scanner 111 driven by an image signal from the controller 120 is deflected by a mirror 113, and the photosensitive drum 112 that rotates in a clockwise direction is irradiated with the laser light, forming an electrostatic latent image on the photosensitive drum. Furthermore, the electrostatic latent image thus formed on the photosensitive drum is then visualized as a toner image by the developing device 114.

Subsequently, the toner image on the photosensitive drum is transferred to the sheet S by the transfer charger 115 in a transfer unit 112*b*. Furthermore, the sheet S to which the toner image is thus transferred is conveyed to a fixing apparatus 118 by a conveyance belt 117 after electrostatic separation from the photosensitive drum 112 by the separation charger 116, and then discharged by discharge rollers 119. Note that the image forming unit 901 and the fixing apparatus 118 form an image on the sheet S fed from a sheet feeding apparatus 30 (or the sheet feeding apparatuses 1001 to 1004).

A discharge sensor 122 is arranged in a conveyance path between the fixing apparatus 118 and the discharge rollers 119. Based on a detection signal of the discharge sensor 122, the controller 120 detects passage of the discharged sheet S.

Furthermore, in the above-described embodiment, the description has been given by taking an image forming apparatus (printer apparatus) having a single function as an example. However, the present invention is not limited to this. The present invention is also applicable to, for example, a copying machine system that integrates an image reading apparatus (scanner apparatus), the image forming apparatus, and an ADF device or may be implemented by adopting a multifunctional system obtained by further adding a facsimile function to the copying machine system.

Furthermore, the description has been given assuming that the image forming unit of the above-described image forming apparatus includes a mechanism that forms an image in accordance with the electrophotographic method. However, the present invention is not limited to this. The present invention may be implemented by adopting, for example, an image forming unit that forms an image in accordance with an inkjet method.

An embodiment regarding the paper deck 3000 serving as a large-volume deck will be described next by taking, as an example, the paper deck 3000 as the sheet feeding apparatus 30 of the image forming system 1000 configured as described above.

First Embodiment

Figure 2:
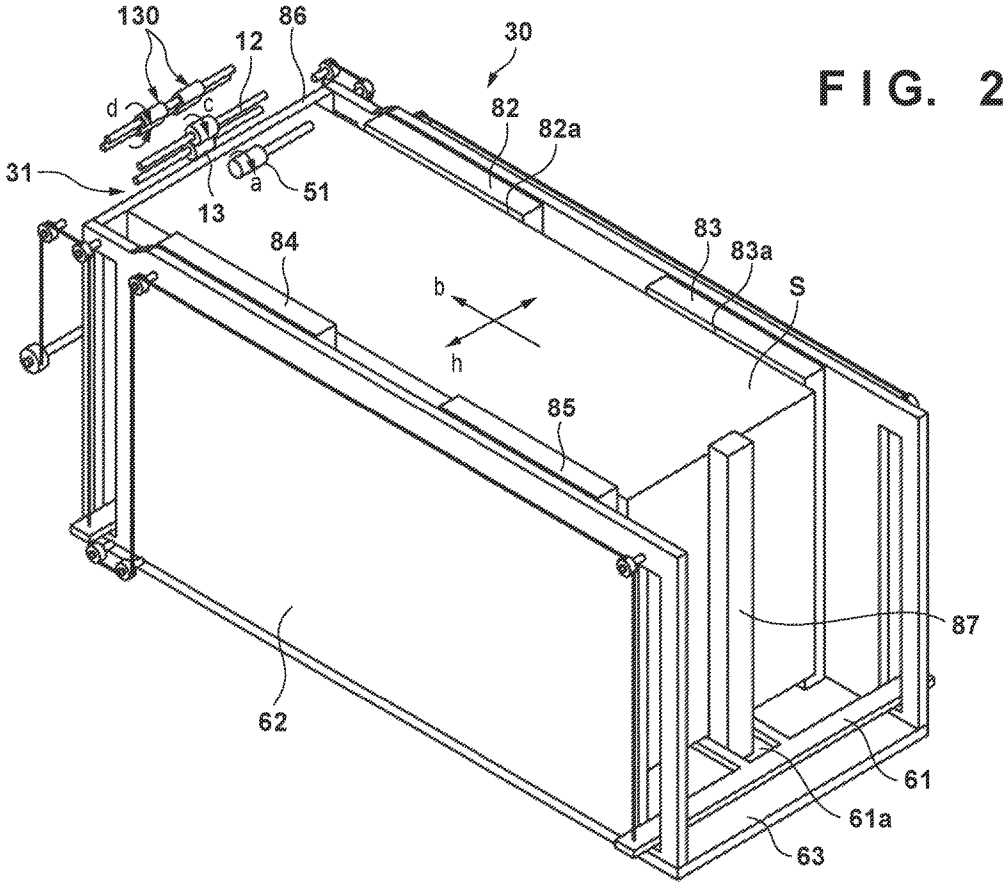
FIG. 2 is a perspective view showing, in a state in which a cover is removed, a main part of a sheet stacking unit according to the first embodiment.

FIG. 2 is a perspective view showing, in a state in which a cover is removed, a main part of a paper deck 3000 according to the first embodiment.

As shown in FIGS. 1 and 2, the paper deck 3000 includes an apparatus main body 3000*a*, a large-volume deck storage 62 accommodated in the apparatus main body 3000*a*, and a sheet feeding apparatus 30. The sheet feeding apparatus 30 feeds sheets S stacked/stored in the large-volume deck storage 62 to an image forming unit 901.

The sheet feeding apparatus 30 includes a paper stacking tray (sheet stacking tray) 61 that stacks sheets S, a pickup roller 51 that feeds the sheets S stacked on the paper stacking tray 61, and a separation/conveyance roller pair 31 constituted by a feed roller 12 and a retard roller 13. The pickup roller 51 is arranged near a leading end portion in a sheet feeding direction (the direction of an arrow b) to be brought into tight contact with the uppermost sheet on the paper stacking tray 61 by an appropriate force. For this reason, the pickup roller 51 is provided above the paper stacking tray 61, contacts the uppermost sheet of the sheets S stacked on the raised paper stacking tray 61, and feeds the sheet in the direction of the arrow b.

The paper stacking tray 61 can stack sheets and is supported so as to undergo a vertical moving operation in a vertical direction (a direction parallel to a gravity direction) by a driving mechanism that includes a vertical moving motor (to be described later). This vertical moving motor is desirably configured to vertically move the paper stacking tray 61 by a single motor. An upper surface detection sensor 50 is arranged on the upstream side of the pickup roller 51 on the upper side of the paper stacking tray 61. The upper surface detection sensor 50 is located above the paper stacking tray 61 and detects an upper surface 68 of the sheet S on the paper stacking tray. When the paper stacking tray 61 is lowered the most, the paper stacking tray 61 contacts a base plate 63 of the sheet feeding apparatus 30. As indicated by a dotted line 81 in FIG. 1, the paper stacking tray 61 rises when the volume of stacked sheets decreases.

The sheet feeding apparatus 30 includes the paper stacking tray 61 and two pairs of side restriction members 82, 83, 84, and 85. The side restriction members 82, 83, 84, and 85 are arranged such that side end positions 82*a* and 83*a* in a widthwise direction (the direction of an arrow h in FIG. 2) perpendicular to the feeding direction (the direction of the arrow b in FIG. 2) of the sheets S stacked on the paper stacking tray 61 can be restricted, and both of them can move in the widthwise direction.

In this embodiment, the pickup roller 51 is configured to be brought into tight contact with the uppermost sheet of the sheets S on the paper stacking tray by an appropriate force, as described above. Each sheet S on the paper stacking tray 61 is separated and fed by the pickup roller 51 and the separation/conveyance roller pair 31 each performing a vertical moving operation and rotating at a predetermined timing.

In a connecting portion 14 with an image forming apparatus 900 of the paper deck 3000, a connecting conveyance path 32 that feeds the sheet S from the side of the paper deck 3000 to a pre-registration roller pair 130 on the side of the image forming apparatus 900 is arranged.

The two pairs of the side restriction members 82, 83, 84, and 85 are configured to be able to guide the sheets S on the paper stacking tray 61 by sliding up to the widths of all sheet sizes compatible with specifications. That is, the side restriction members are supported to be movable in a sheet widthwise direction and restrict the both sides positions of the sheets S by contacting the both end portions of the stacked sheets S. Note that a leading end restriction unit 86 in FIG. 2 restricts the leading end portion of each sheet S on the paper stacking tray 61.

In addition, a trailing end restriction member 87 is arranged so as to restrict the trailing end portion of each sheet S on the paper stacking tray 61. The trailing end restriction member 87 is supported to be movable in a direction parallel to the sheet feeding direction (the direction of the arrow b) and restricts the trailing end position of each sheet S. The trailing end restriction member 87 is moved along an elongated positioning hole portion 61*a* (FIG. 2) formed in the center portion of the paper stacking tray 61.

As shown in FIG. 2, when the pickup roller 51 is driven by a driving motor (not shown) to rotate in a direction (the direction of an arrow a) of feeding the sheets S, the uppermost sheet S is fed in the direction of the arrow b. Consequently, the sheet S contacts a nip portion of the separation/conveyance roller pair 31 adjacent to the exist side of the pickup roller 51.

When double feed of the sheets S fed by the pickup roller 51 occurs, the following operation is performed. That is, the retard roller 13 that is driven to/rotates in a direction opposite to the feed roller 12 that rotates in the same direction as the arrow a (the direction of an arrow c) rotates in the same direction as the feed roller 12 by the intervention of two or more sheets S in the nip portion. Then, the second and subsequent sheets S in the nip portion are pushed back to the direction of the paper stacking tray 61 by the retard roller 13, and only one uppermost sheet S is fed to the direction of the arrow b by the feed roller 12.

When the sheet S is fed from the paper deck 3000 having the above arrangement or one of the aforementioned first to fourth sheet feeding apparatuses 1001 to 1004, the leading end of the sheet S abuts against the nip portion of the pre-registration roller pair 130. The pre-registration roller pair 130 is formed by a pair of counter rollers and arranged on a conveyance path of the sheet S to be rotatable in the direction of an arrow d in FIG. 2 by a driving motor (not shown). The sheet S that once abuts against the nip portion of the pre-registration roller pair 130 is conveyed to the inside of the image forming apparatus 900 by the pre-registration roller pair 130 that rotates in accordance with a feeding timing.

Lifter Mechanism of Paper Stacking Tray 61

The vertical moving operation of the paper stacking tray 61 will be described here.

Figure 3:
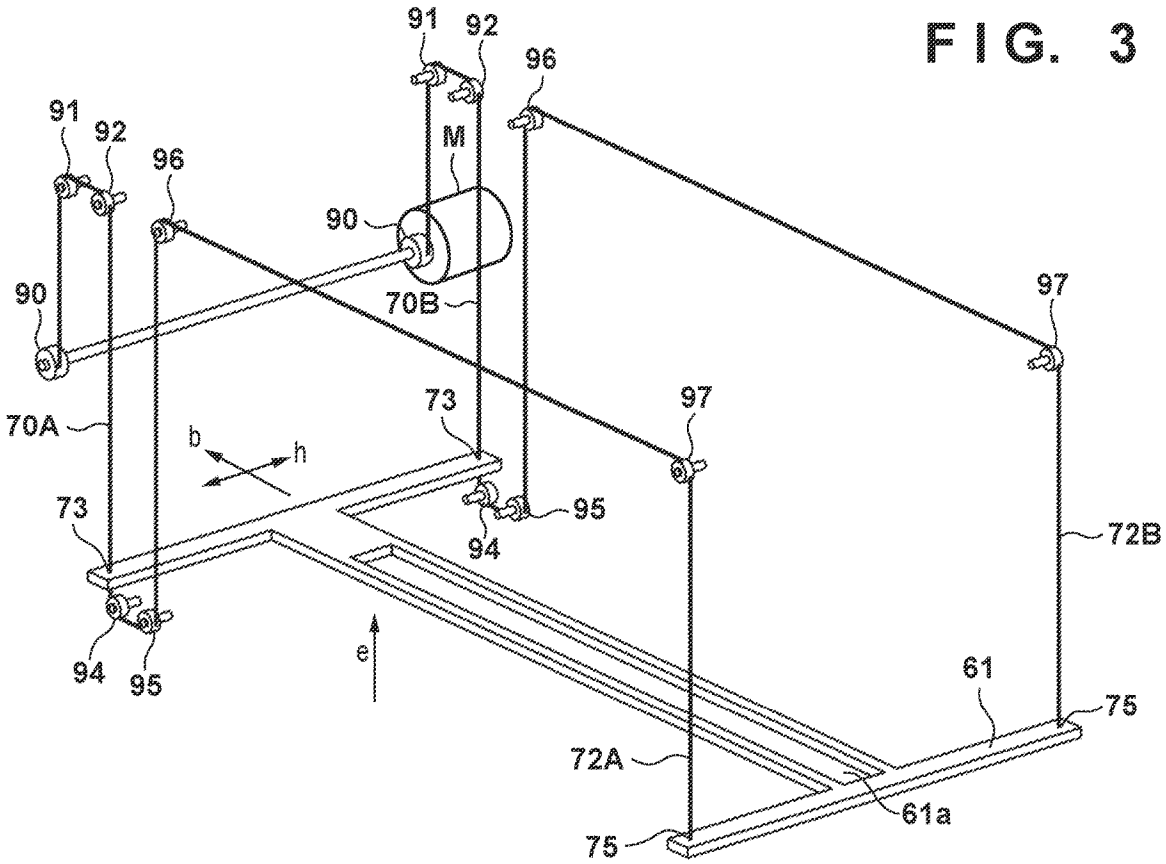
FIG. 3 is a perspective view showing the arrangement of wires that hang a sheet stacking tray in the sheet stacking unit according to the first embodiment.

FIG. 3 is a perspective view showing the suspension arrangement of wires for describing a lifter mechanism of the paper stacking tray 61.

As shown in FIGS. 2 and 3, one end of each of four wires 70A, 70B, 72A, and 72B is connected to a corresponding one of four wire connecting portions 73 and 75 provided in portions beam-like extending from the four corners of the paper stacking tray 61, and the paper stacking tray 61 is hung by the four wires. The paper stacking tray 61 rises when a roll-up unit 90 connected to a motor M rolls up the two wires 70A and 70B via a driving mechanism by a driving force generated by the motor. On the other hand, the paper stacking tray 61 lowers when the roll-up unit 90 rolls down the two wires 70A and 70B.

As shown in FIGS. 2 and 3, the shape of the paper stacking tray 61 prevents the two pairs of movable side restriction members 82, 83, 84, and 85 and the movable trailing end restriction member 87 from interfering with each other. That is, the paper stacking tray 61 is shaped so as to include beams extending in a direction (the direction of the arrow h) perpendicular to the sheet feeding direction (the direction of the arrow b) in the front portion and rear portion of the sheet feeding direction with respect to the barycenter of the paper stacking tray 61 as the center, and a flat plate that connects these two beams. Then, there is a concave space between these two beams. On the other hand, an elongated positioning hole portion 61*a* is formed in the center portion of the flat plate.

Then, the side restriction members 82, 83, 84, and 85 can move in the concave space, and the trailing end restriction member 87 can move in the elongated positioning hole portion 61*a*, making it possible to guide the sheets S of a plurality of sizes. The four wire connection portions 73 and 75 hanging the paper stacking tray 61 are installed on the same beam at the both ends of the front portion and at the both ends of the rear portion, respectively, in the sheet feeding direction of the paper stacking tray 61, and provided on different beams at the both ends in the sheet feeding direction (the direction of the arrow b).

Wire Arrangement

The arrangement of wires that vertically move the paper stacking tray 61 will be described here.

The four wires 70A, 70B, 72A, and 72B for vertically moving the paper stacking tray 61 are installed in the both end portions of the paper stacking tray 61 in the widthwise direction (the direction of the arrow h) with the same arrangement, as shown in FIG. 3. The wire connecting portions of the paper stacking tray 61 include the front portion and the rear portion with respect to the barycenter of the paper stacking tray 61 in the sheet feeding direction (the direction of the arrow b).

Figure 4:
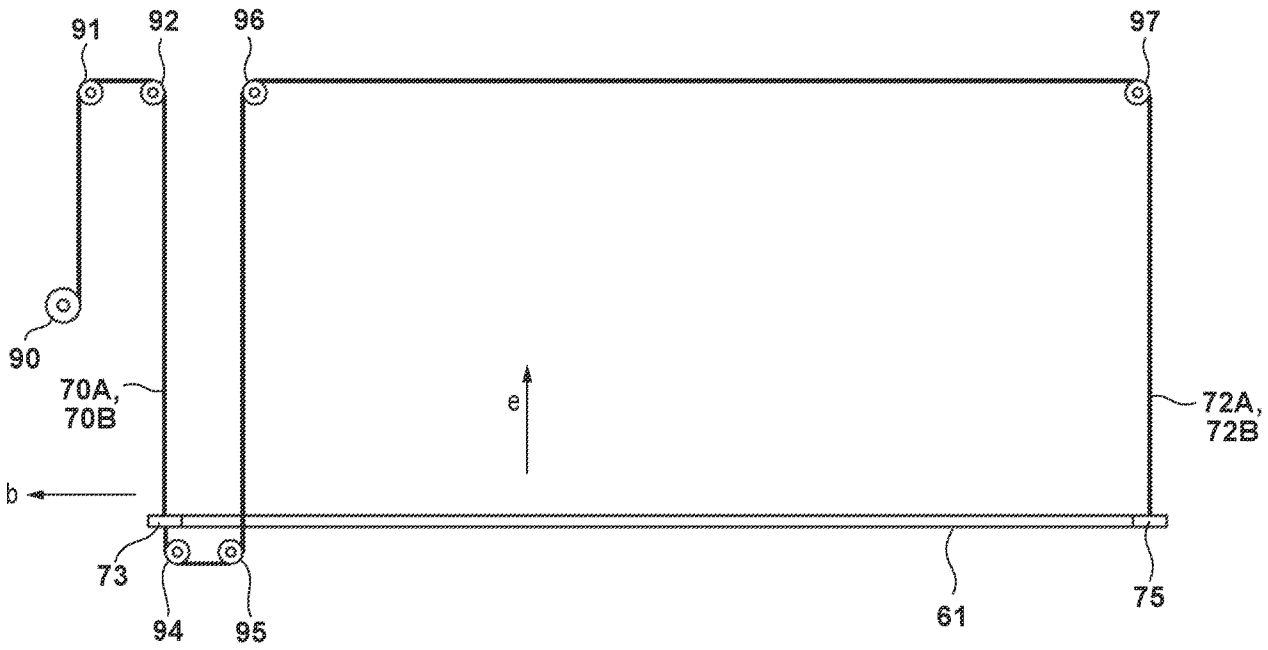
FIG. 4 is a sectional view showing the arrangement of the wires that hang the sheet stacking tray in the sheet stacking unit according to the first embodiment.
Figure 5:
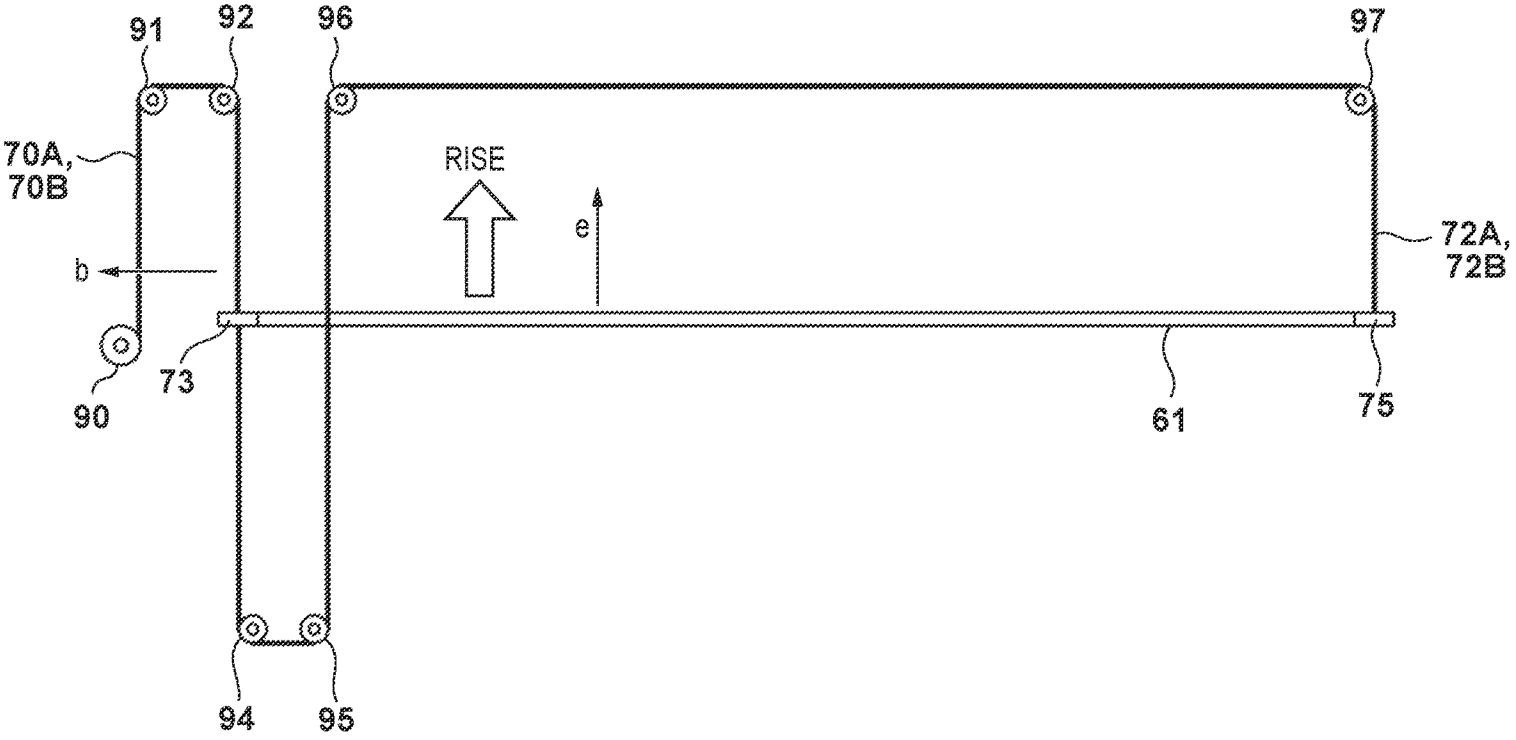
FIG. 5 is a sectional view showing a state in which the sheet stacking tray is lifted up in the sheet stacking unit according to the first embodiment.

FIG. 4 is a side sectional view showing a state in which the paper stacking tray 61 is lowered. FIG. 5 is a side sectional view showing a state in which the paper stacking tray 61 is lifted up.

As shown in FIGS. 4 and 5, the other end of each of the two wires 70A and 70B swaged on the lower side of the paper stacking tray 61 by a swage portion (not shown) and connected to the two wire connecting portions 73 in the front portion is connected to the roll-up unit 90 via a plurality of pulleys 91 and 92. The roll-up unit 90 rotates by driving a motor (not shown), vertically moving the paper stacking tray 61.

On the other hand, the remaining two wires 72A and 72B connected to the two wire connecting portions 75 in the rear portion are connected on a side opposite to a lifting direction (the direction of an arrow e) of the paper stacking tray 61 in the wire connecting portion 73 via a plurality of pulleys 94, 95, 96, and 97. The wires 72A and 72B may be arranged to be swaged on the upper side of the paper stacking tray 61 by a swage portion (not shown) and connected to the wire connecting portion 73. The wires 72A and 72B may also be arranged to be provided at a position shifted in, for example, the direction of the arrow h or the direction of the arrow b with respect to the wire connecting portion 73. More specifically, the wires 72A and 72B may be provided at a position in a range up to about 10% of the short side of a stackable sheet with the maximum length in the direction of the arrow h or a position in a range up to about 10% of the long side of the stackable sheet with the maximum length in the direction of the arrow b. If the wire connecting portion 73 is lifted as a result of this, the wire connecting portion 75 linked by the two wires 72A and 72B is also pulled and lifted up together. Note that the wire connecting portion 73 and the wire connecting portion 75 are linked by the wires 72A and 72B, and thus they are always in the same direction regarding vertical moving operations and have the same vertical moving amount. If the wire connecting portion 73 is vertically moved, the wire connecting portion 75 is also vertically moved together.

As shown in FIG. 5, when the roll-up unit 90 rolls up the wires 70A and 70B, the paper stacking tray 61 is lifted up by the wires 70A and 70B and raised, the wires 72A and 72B are pulled to the wire connecting portion 73, and the wire connecting portion 75 is also lifted up.

Therefore, as can be seen in the arrangements shown in FIGS. 4 and 5, the paper stacking tray 61 can be vertically moved, by driving the motor, between positions where the pulleys 91, 92, 96, and 97 are provided and positions where the pulleys 94 and 95 are provided. Since a distance from the wire connecting portion 73 to the wire connecting portion 75 is long, the wires 72A and 72B may extend, causing a bend in each wire. In this case, the pulleys 94 and 95 can change their positions in a vertical direction, making it possible to adjust the bend in each wire by changing the positions of the pulleys 94 and 95.

Therefore, according to the above-described embodiment, a wire winding mechanism is only provided in the end portion of the paper stacking tray on the downstream side of a sheet conveyance direction, making it possible to making a space related to vertical movement of the paper stacking tray smaller. This contributes to downsizing of the paper deck. The above-described wire winding mechanism and wire arrangement are provided on both sides in the direction of the arrow h. It is only necessary, however, that at least the one side includes the above-described mechanism.

Second Embodiment

In a case where an arrangement capable of stacking sheets long in their conveyance direction, or so-called elongated sheets is adopted, the center portion of a paper stacking tray easily suffers from flexural deformation owing to the weight of the stacked sheets. Therefore, in this embodiment, an arrangement for preventing or at least reducing such flexural deformation will be described, in addition to the above-described first embodiment.

Figure 6:
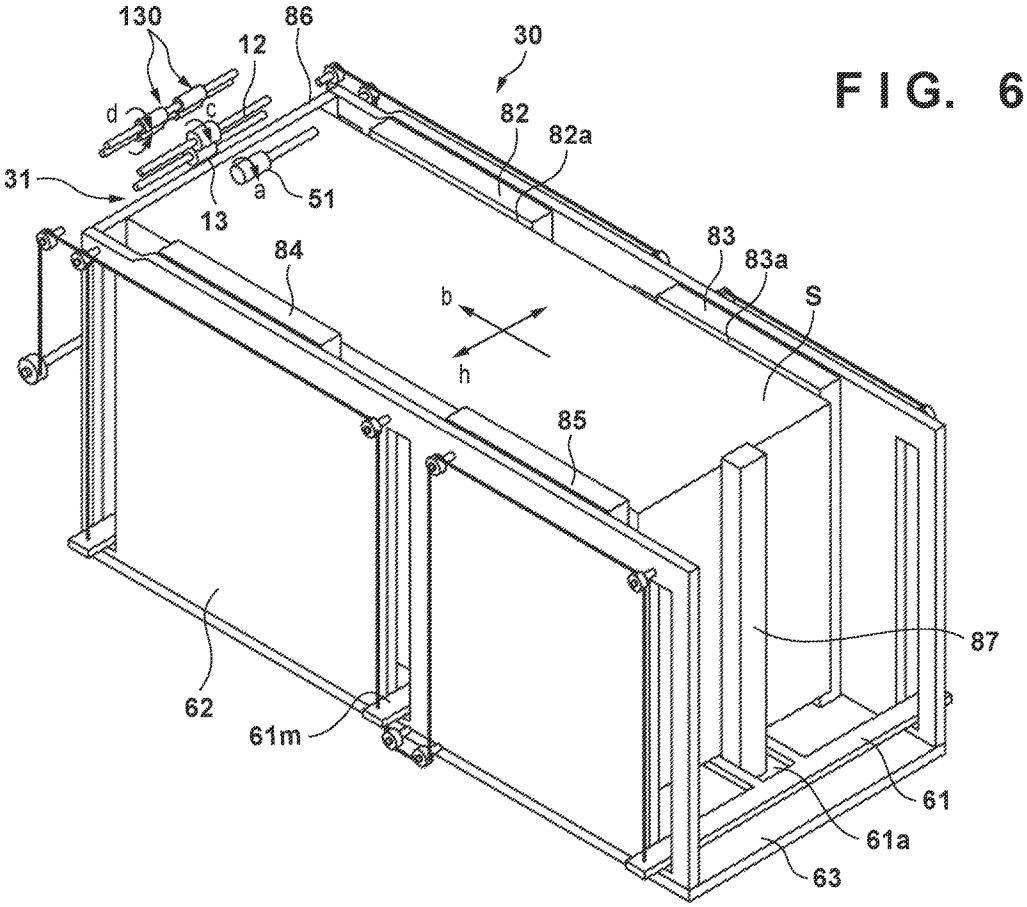
FIG. 6 is a perspective view showing, in a state in which a cover is removed, a main part of a sheet stacking unit according to the second embodiment.

FIG. 6 is a perspective view showing, in a state in which a cover is removed, a main part of a paper deck 3000 according to the second embodiment. Note that in FIG. 6, the same reference numerals denote the same constituent elements as those that have already been described in the first embodiment, and a description thereof will be omitted.

As can be seen by comparing FIG. 6 with FIG. 2, in the center portion of a paper stacking tray 61 according to this embodiment, a beam 61*m* is provided in a direction (the direction of an arrow h in FIG. 6) perpendicular to a sheet conveyance direction. Then, other wire connecting portions are provided in the end portions of the beam 61*m* in the direction of the arrow h.

Lifter Mechanism of Paper Stacking Tray 61

Figure 7:
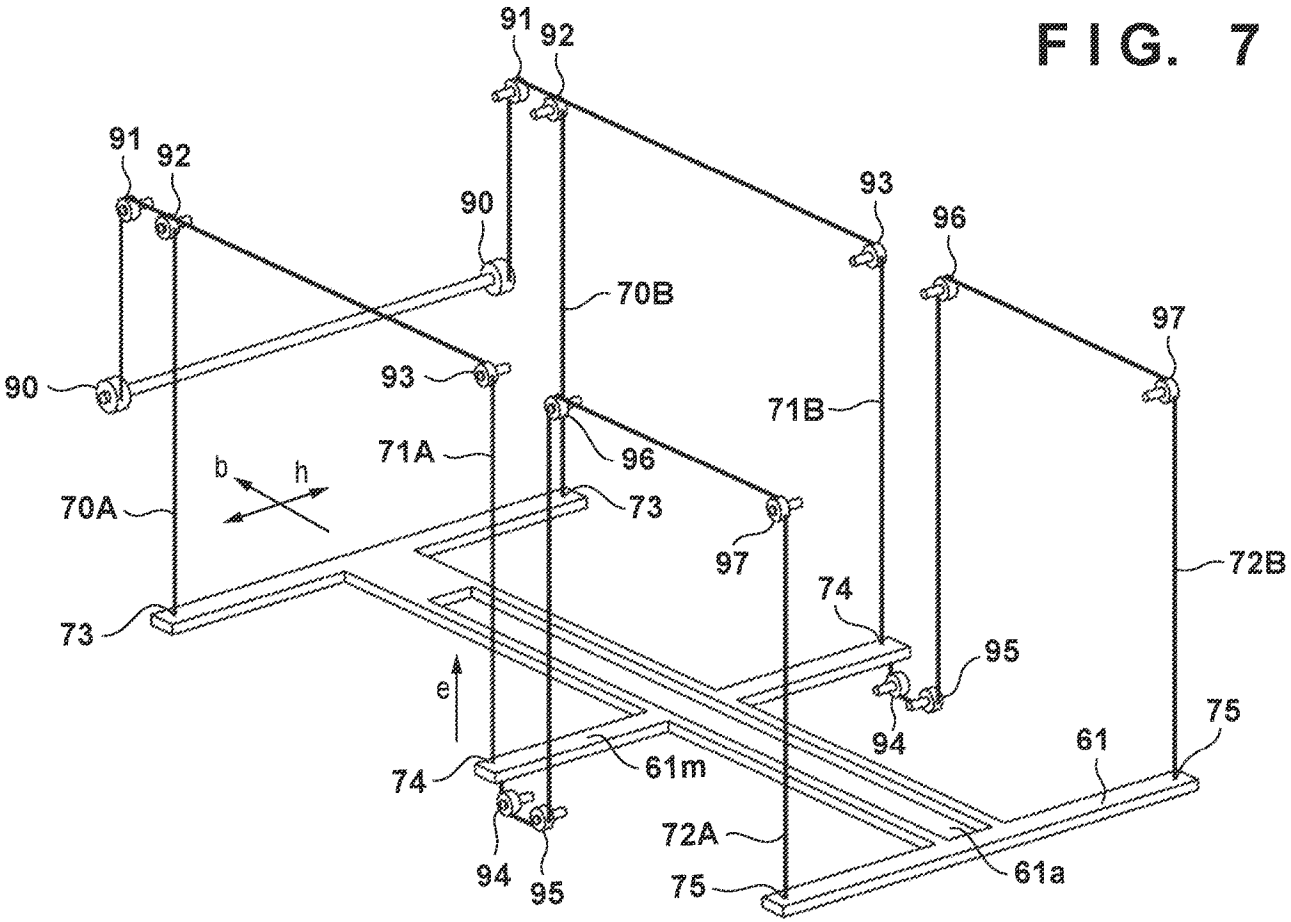
FIG. 7 is a perspective view showing the arrangement of wires that hang a sheet stacking tray in the sheet stacking unit according to the second embodiment.

FIG. 7 is a perspective view showing the suspension arrangement of wires for explaining a lifter mechanism of the paper stacking tray 61 according to the second embodiment. Note that in FIG. 7, the same reference numerals denote the same constituent elements as those that have already been described in the first embodiment, and a description thereof will be omitted. Only an arrangement characteristic to this embodiment will be described here.

As shown in FIG. 7, a plurality of wires 70A, 70B, 71A, 71B, 72A, and 72B are connected to respective wire connecting portions 73, 74, and 75 of the paper stacking tray 61, and the paper stacking tray 61 is hung by these wires.

As shown in FIGS. 6 and 7, the paper stacking tray 61 is shaped so as to include the beam 61*m* extending in the direction of the arrow h near the center portion (a portion to be the barycenter of the paper stacking tray 61) concerning the direction of an arrow b. This beam 61*m* is desirably provided at a position in a range corresponding to ±20% of a stackable sheet with the maximum size from the center of a stackable sheet with the maximum length in a direction parallel to the arrow b. Furthermore, the beam 61*m* is provided in a place where movability of two pairs of side restriction members 82, 83, 84, and 85 and a trailing end restriction member 87 is not disturbed. In this embodiment, the wire connecting portions 74 hanging the paper stacking tray 61 in the beam 61*m* are provided in the end portions of the beam 61*m* in the direction of the arrow h.

Wire Arrangement

A wire arrangement according to this embodiment that vertically moves the paper stacking tray 61 will be described here.

As shown in FIG. 7, the wire connecting portions 73, 74, and 75 of the paper stacking tray 61 are provided in the front portion, intermediate portion, and rear portion of the paper stacking tray 61 concerning a sheet feeding direction (the direction of the arrow b).

Figure 8:
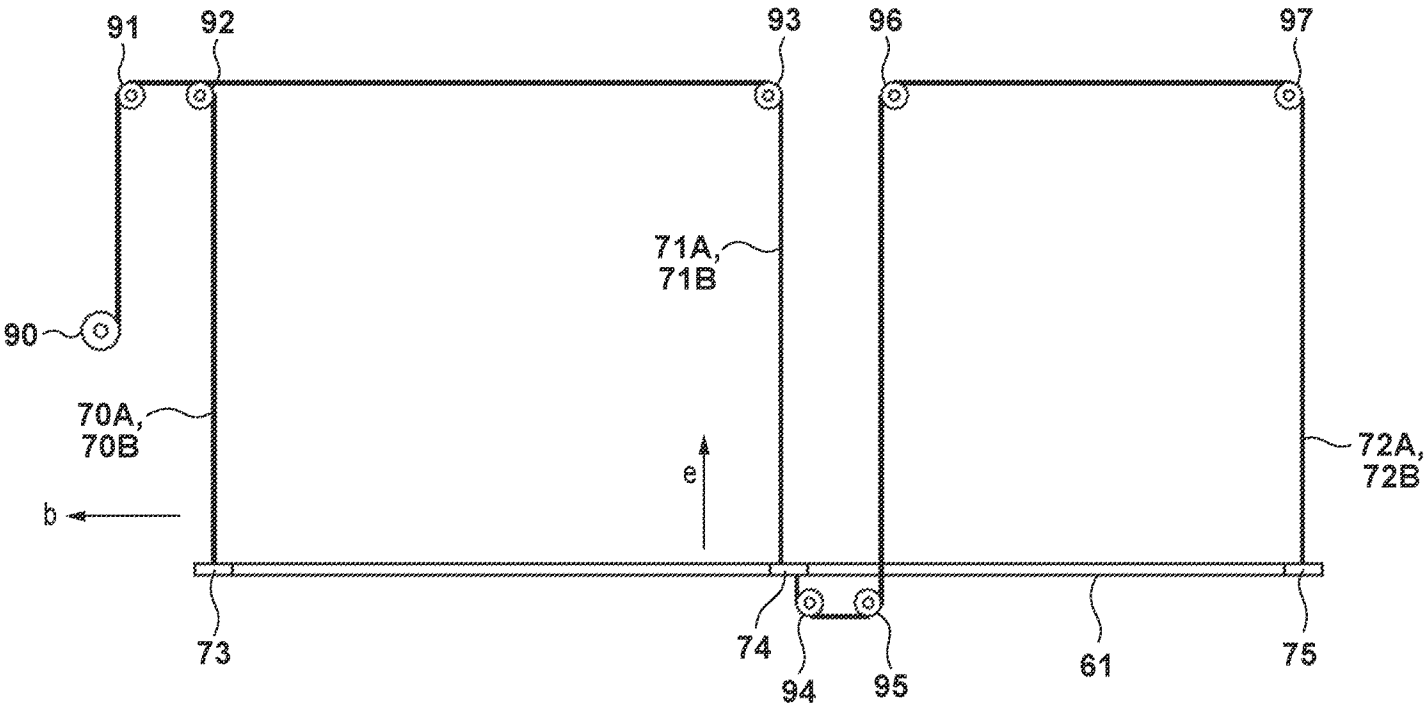
FIG. 8 is a sectional view showing the arrangement of the wires that hang the sheet stacking tray in the sheet stacking unit according to the second embodiment.
Figure 9:
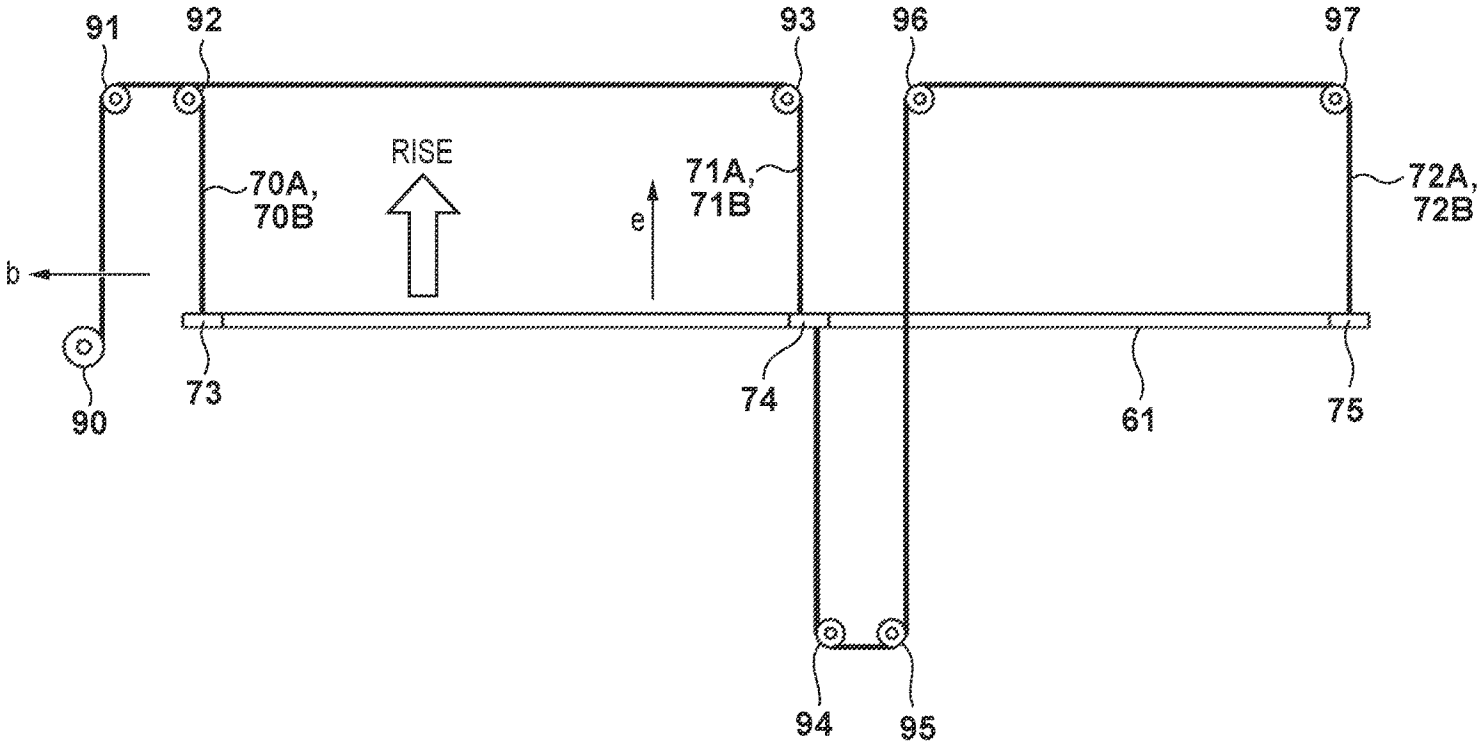
FIG. 9 is a sectional view showing a state in which the sheet stacking tray is lifted up in the sheet stacking unit according to the second embodiment.

FIG. 8 is a side sectional view showing a state in which the paper stacking tray 61 is lowered. FIG. 9 is a side sectional view showing a state in which the paper stacking tray 61 is lifted up.

As shown in FIGS. 7 and 8, the wire connecting portions 73 in the front portion are swaged on the lower side of the paper stacking tray 61 by a swage portion (not shown). The other end of each of the wires 70A and 70B, and the wires 71A and 71B connected to the wire connecting portions 74 in the intermediate portion is connected to a roll-up unit 90 via a plurality of pulleys 91, 92, and 93. The paper stacking tray 61 is vertically moved by rotating the roll-up unit 90.

The wires 72A and 72B connected to the wire connecting portions 75 in the rear portion are connected in a direction opposite to a hanging direction (the direction of an arrow e) of the wire connecting portions 74 in the intermediate portion via a plurality of pulleys 94, 95, 96, and 97. If the wire connecting portions 74 in the intermediate portion are lifted, the wire connecting portions 75 in the rear portion linked with the wire connecting portions 74 in the intermediate portion by the wires 72A and 72B are also pulled and lifted up together. Note that the wire connecting portions 74 in the intermediate portion and the wire connecting portions 75 in the rear portion are linked by the wires 72A and 72B, and thus they are always in the same direction regarding vertical moving operations and have the same vertical moving amount. Therefore, if the wire connecting portions 74 in the intermediate portion are vertically moved, the wire connecting portions 75 in the rear portion are also vertically moved together.

As shown in FIG. 9, when the roll-up unit 90 rolls up the wires, the paper stacking tray 61 is lifted up by the wires 70A, 70B, 71A, and 71B and raised, the wires 72A and 72B are pulled by the wire connecting portion 74 in the intermediate portion, and the wire connecting portion 75 in the rear portion is also lifted up.

Therefore, as can be seen in the arrangements shown in FIGS. 8 and 9, the paper stacking tray 61 can be vertically moved, by driving the motor, between positions where the pulleys 91, 92, 93, 96, and 97 are provided and positions where the pulleys 94 and 95 are provided.

Therefore, according to the above-described embodiment, in addition to the arrangement described in the first embodiment, the beam is provided in the intermediate portion of the paper stacking tray, and the additional wire connecting portions are provided in the end portions of the beam, making it possible to hang the intermediate portion of the paper stacking tray as well by the wires. Consequently, although the intermediate portion of the paper stacking tray easily suffers from flexural deformation in a downward direction owing to the weight of the stacked sheets, a force added by a user, or the like, it is possible to prevent or reduce a bend or deformation in the intermediate portion in the downward direction by providing the wire connecting portions in the intermediate portion to hang it by the wires.

If the beam in the intermediate portion of the paper stacking tray is lifted up in a direction (upward direction) opposite to a vertical direction due to an operation error by the user, a portion which is not so tolerable in strength (for example, the intermediate portion) may be deformed in the arrangement of the first embodiment. In the arrangement of this embodiment, however, the wire connecting portions in the rear portion are also raised in the same manner when the intermediate portion is raised. Consequently, a force of raising the intermediate portion upward is canceled by a force of raising the wire connecting portions in the rear portion with the intermediate portion, making it possible to prevent or reduce deformation in the paper stacking tray in the upward direction.

Note that an arrangement that provides one beam in the intermediate portion of the paper stacking tray has been adopted in the second embodiment. However, the present invention is not limited to this. An arrangement that provides two or more beams in the intermediate portion, and lifts these beams by wires may be adopted. At this time, an arrangement that makes the interval between the respective beams equal is desirable. This makes it possible to prevent a bend or deformation in the intermediate portion more reliably.

In any case, according to the arrangements of the above-described embodiments, as shown in FIGS. 3 to 5 and FIGS. 7 to 9, there are the plurality of wire connecting portions (for example, the connecting portions 73 and 74) to which the plurality of wires are connected on the paper stacking tray. An arrangement is adopted in which in these connecting portions, one wire is hung in a direction of raising the paper stacking tray, and the other wire is pulled in a direction opposite to the direction of raising the paper stacking tray.

Furthermore, in the above-described embodiments, an arrangement that provides a beam and lifts the beam by wires has been adopted. However, the present invention is not limited to this. For example, an arrangement that lifts, without providing any beam, a stacking tray by providing it with wire connecting portions may be adopted. This case has the advantage of being able to vertically move the stacking tray while maintaining a balance with a simpler arrangement.

Furthermore, in the above-described embodiments, an arrangement that provides wires along a feeding direction of a print medium has been adopted. However, the present invention is not limited to this. An arrangement that provides wires in a direction parallel to the long side of a stackable sheet with the maximum size may be adopted.

Furthermore, in the above-described embodiments, an arrangement that uses the paper deck and the image forming apparatus independently has been adopted. However, the present invention is not limited to this. An arrangement that incorporates the paper deck in the image forming apparatus may be adopted.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-088573, filed Apr. 27, 2017, which is hereby incorporated by reference herein in its entirety.

What is claimed is:

1. A sheet stacking apparatus comprising:

a stacking unit capable of stacking a sheet;

a restriction unit movable, in a conveyance direction in which the sheet stacked by the stacking unit is conveyed, in a restriction direction of restricting movement of the sheet stacked by the stacking unit and a release direction of releasing the restriction;

a first lifting unit configured to lift the stacking unit;

a second lifting unit different from the first lifting unit to lift the stacking unit;

a third lifting unit different from the first lifting unit and the second lifting unit to lift the stacking unit; and a roll-up unit configured to raise the stacking unit by rolling up the first lifting unit and the second lifting unit, and lowering the stacking unit by releasing the first lifting unit and the second lifting unit, wherein the stacking unit includes, in the conveyance direction, a first connecting portion, a second connecting portion, and a third connecting portion to which the first lifting unit, and the second lifting unit, and the third lifting unit are, respectively, connected at a plurality of positions and an elongated hole for the restriction unit to move, in the conveyance direction, the second connecting portion is provided on a downstream side of the third connecting portion, and the first connecting portion is provided on the downstream side of the second connecting portion, the first lifting unit is provided to be connected to the first connecting portion and to lift the stacking unit by acting on the first connecting portion when rolled up by the roll-up unit, the second lifting unit is provided to be connected to the second connecting portion and to lift the stacking unit by acting on the second connecting portion when rolled up by the roll-up unit, and the third lifting unit is provided to be connected to the second connecting portion at one end, to be connected to the third connecting portion at the other end, and when the roll-up unit rolls up the first lifting unit and the second lifting unit, to be drawn to the second connecting portion lifted by an action of the second lifting unit and to lift the stacking unit by acting on the third connecting portion on the stacking unit.

2. The apparatus according to claim 1, wherein in the second connecting portion, a connecting point with the second lifting unit and a connecting point with the third lifting unit are the same.

3. The apparatus according to claim 1, wherein in the second connecting portion, a connecting point with the second lifting unit and a connecting point with the third lifting unit are different in a predetermined range, and a distance between the connecting point with the second lifting unit and the connecting point with the third lifting unit is smaller than a distance between the first connecting portion and the second connecting portion, and smaller than a distance between the second connecting portion and the third connecting portion.

4. The apparatus according to claim 1, further comprising:

a first support unit provided below the stacking unit and configured to support the third lifting unit; and a second support unit provided above the stacking unit and configured to support the third lifting unit, wherein the third lifting unit drawn to the second connecting portion lifts the stacking unit via the first support unit and the second support unit.

5. The apparatus according to claim 4, wherein the stacking unit can be vertically moved between the first support unit and the second support unit.

6. The apparatus according to claim 5, wherein a position of the second support unit is changeable in a direction of vertically moving the stacking unit, and a lifting action of the second lifting unit is adjusted by changing the position of the second support unit.

7. The apparatus according to claim 4, wherein the first support unit and the second support unit are pulleys.

8. The apparatus according to claim 1, further comprising a driving unit configured to generate a driving force of rotating the roll-up unit in a first direction and a second direction.

9. The apparatus according to claim 1, wherein the first lifting unit, the second lifting unit, and the third lifting unit are, respectively, connected to corresponding connecting portions at positions outside a stacking region where the stacking unit can stack the sheet.

10. The apparatus according to claim 1, wherein the stacking unit includes concave portions between the first connecting portion and the second connecting portion, and between the second connecting portion and the third connecting portion, and the first connecting portion, the second connecting portion, and the third connecting portions are provided in beam-like convex portions formed by providing the concave portions.

11. The apparatus according to claim 10, further comprising, in a widthwise direction perpendicular to the conveyance direction, a plurality of restriction members provided on both sides of the sheet stacked by the stacking unit and configured to restrict movement in the widthwise direction, wherein the plurality of restriction members are provided in the concave portions.

12. The apparatus according to claim 11, wherein at least one of the plurality of restriction members can move in accordance with a size of the sheet stacked by the stacking unit.

13. A sheet feeding apparatus comprising:

a stacking unit capable of stacking a sheet;

a restriction unit movable, in a conveyance direction in which the sheet stacked by the stacking unit is conveyed, in a restriction direction of restricting movement of the sheet stacked by the stacking unit and a release direction of releasing the restriction;

a feeding unit configured to contact and feed an uppermost sheet stacked by the stacking unit;

a first lifting unit configured to lift the stacking unit;

a second lifting unit different from the first lifting unit to lift the stacking unit;

a third lifting unit different from the first lifting unit and the second lifting unit to lift the stacking unit; and a roll-up unit configured to raise the stacking unit by rolling up the first lifting unit and the second lifting unit, and lowering the stacking unit by releasing the first lifting unit and the second lifting unit, wherein the stacking unit includes, in the conveyance direction, a first connecting portion, a second connecting portion, and a third connecting portion to which the first lifting unit, and the second lifting unit, and the third lifting unit are, respectively, connected at a plurality of positions and an elongated hole for the restriction unit to move, in a direction parallel to a long side of a sheet with a maximum length stackable by the stacking unit, the second connecting portion is provided closer to a side of the restriction direction than the third connecting portion, and the first connecting portion is provided closer to the side of the restriction direction than the second connecting portion, the first lifting unit is provided to be connected to the first connecting portion and to lift the stacking unit by acting on the first connecting portion when rolled up by the roll-up unit, the second lifting unit is provided to be connected to the second connecting portion and to lift the stacking unit by acting on the second connecting portion when rolled up by the roll-up unit, and the third lifting unit is provided to be connected to the second connecting portion at one end, to be connected to the third connecting portion at the other end, and when the roll-up unit rolls up the first lifting unit and the second lifting unit, to be drawn to the second connecting portion lifted by an action of the second lifting unit and to lift the stacking unit by acting on the third connecting portion on the stacking unit.

14. An image forming apparatus comprising:

a stacking unit capable of stacking a sheet;

a restriction unit movable, in a conveyance direction in which the sheet stacked by the stacking unit is conveyed, in a restriction direction of restricting movement of the sheet stacked by the stacking unit and a release direction of releasing the restriction;

a feeding unit configured to contact and feed an uppermost sheet stacked by the stacking unit;

an image forming unit configured to form an image on the sheet fed by the feeding unit;

a first lifting unit configured to lift the stacking unit;

a second lifting unit different from the first lifting unit to lift the stacking unit;

a third lifting unit different from the first lifting unit and the second lifting unit to lift the stacking unit; and a roll-up unit configured to raise the stacking unit by rolling up the first lifting unit and the second lifting unit, and lowering the stacking unit by releasing the first lifting unit and the second lifting unit, wherein the stacking unit includes, in the conveyance direction, a first connecting portion, a second connecting portion, and a third connecting portion to which the first lifting unit, and the second lifting unit, and the third lifting unit are, respectively, connected at a plurality of positions and an elongated hole for the restriction unit to move, in the conveyance direction, the second connecting portion is provided on a downstream side of the third connecting portion, and the first connecting portion is provided on the downstream side of the second connecting portion, the first lifting unit is provided to be connected to the first connecting portion and to lift the stacking unit by acting on the first connecting portion when rolled up by the roll-up unit, the second lifting unit is provided to be connected to the second connecting portion and to lift the stacking unit by acting on the second connecting portion when rolled up by the roll-up unit, and the third lifting unit is provided to be connected to the second connecting portion at one end, to be connected to the third connecting portion at the other end, and when the roll-up unit rolls up the first lifting unit and the second lifting unit, to be drawn to the second connecting portion lifted by an action of the second lifting unit and to lift the stacking unit by acting on the third connecting portion on the stacking unit.

15. An image forming system comprising:

a sheet feeding apparatus; and an image forming apparatus, wherein the sheet feeding apparatus comprises:

a stacking unit capable of stacking a sheet;

a restriction unit movable, in a conveyance direction in which the sheet stacked by the stacking unit is conveyed, in a restriction direction of restricting movement of the sheet stacked by the stacking unit and a release direction of releasing the restriction;

a feeding unit configured to contact and feed an uppermost sheet stacked by the stacking unit;

a first lifting unit configured to lift the stacking unit;

a second lifting unit different from the first lifting unit to lift the stacking unit;

a third lifting unit different from the first lifting unit and the second lifting unit to lift the stacking unit; and a roll-up unit configured to raise the stacking unit by rolling up the first lifting unit and the second lifting unit, and lowering the stacking unit by releasing the first lifting unit and the second lifting unit, wherein the stacking unit includes, in the conveyance direction, a first connecting portion, a second connecting portion, and a third connecting portion to which the first lifting unit, and the second lifting unit, and the third lifting unit are, respectively, connected at a plurality of positions and an elongated hole for the restriction unit to move, in a direction parallel to a long side of a sheet with a maximum length stackable by the stacking unit, the second connecting portion is provided closer to a side of the restriction direction than the third connecting portion, and the first connecting portion is provided closer to the side of the restriction direction than the second connecting portion, the first lifting unit is provided to be connected to the first connecting portion and to lift the stacking unit by acting on the first connecting portion when rolled up by the roll-up unit, the second lifting unit is provided to be connected to the second connecting portion and to lift the stacking unit by acting on the second connecting portion when rolled up by the roll-up unit, the third lifting unit is provided to be connected to the second connecting portion at one end, to be connected to the third connecting portion at the other end, and when the roll-up unit rolls up the first lifting unit and the second lifting unit, to be drawn to the second connecting portion lifted by an action of the second lifting unit and to lift the stacking unit by acting on the third connecting portion on the stacking unit, and the image forming apparatus comprises an image forming unit configured to form an image on the sheet fed by the feeding unit.

* * * * *